United States Patent [19]

Eichorn, deceased et al.

[11] 4,093,367

[45] June 6, 1978

[54] IMAGING APPARATUS

[75] Inventors: Roger H. Eichorn, deceased, late of Webster, N.Y.; by Lincoln First Bank of Rochester, executor, Rochester, N.Y.; Morton Silverberg, Rochester, both of N.Y.

[73] Assignee: Xerox Corporation, Stamford, Conn.

[21] Appl. No.: 569,237

[22] Filed: Apr. 18, 1975

[51] Int. Cl.[2] ..... G03G 15/00

[52] U.S. Cl. ..... 355/3 R; 346/153; 354/5

[58] Field of Search ..... 354/5, 14, 15, 16; 355/16, 3 TR, 3 TE, 3 R; 346/74 P, 74 ES, 153; 101/DIG. 13

[56] References Cited

U.S. PATENT DOCUMENTS

| | | | |
|---|---|---|---|
| 2,985,135 | 5/1961 | Hickerson | 101/DIG. 13 |
| 3,076,393 | 2/1963 | Campbell et al. | 354/5 |
| 3,132,206 | 5/1964 | King | 346/74 P X |
| 3,495,268 | 2/1970 | Hurst | 346/74 ES |
| 3,670,633 | 6/1972 | Mason et al. | 354/11 |

*Primary Examiner*—Joseph W. Hartary

[57] ABSTRACT

A non-impact printing apparatus which employs xerographic techniques to develop a latent image on a transparent photoreceptor and transfer it therefrom to a receiving medium.

34 Claims, 14 Drawing Figures

IMAGING APPARATUS

CROSS-REFERENCE TO RELATED CASES

Related copending applications include U.S. Ser. No. 569,339, filed Apr. 18, 1975 relating to synchronous cam drives, head drives, flitram heads, electrographic heads, xerographic liquid development heads, and conventional xerographic heads; U.S. Ser. No. 569,239, filed Apr. 18, 1975 (now U.S. Pat. No. 3,963,340) relating to manifold heads with reuseable loops; U.S. Ser. No. 569,240, filed Apr. 18, 1975 (now abandoned) relating to a split backup roll; U.S. Ser. No. 569,335, filed Apr. 18, 1975 (now abandoned) relating to thermal and liquid manifold heads in combination with synchronous cam and head drives; U.S. Ser. No. 569,336, filed Apr. 18, 1975 (now abandoned) relating to combinations of synchronous cam drives, head drives and manifold heads with reuseable loops; U.S. Ser. No. 569,337, filed Apr. 18, 1975 (now U.S. Pat. No. 4,003,333) relating to a toner donor belt system; U.S. Ser. No. 569,235, filed Apr. 18, 1975 (now U.S. Pat. No. 3,990,393) relating to a magnetic development system; and U.S. Ser. No. 569,338, filed Apr. 18, 1975 relating to a xerographic typewriter with interpositioned development and synchronous cam and head drives, magnetic development, and a toner donor belt system.

BACKGROUND OF THE INVENTION

This invention is concerned mainly with printing apparatus, and specifically with such apparatus which rely upon non-impact imaging processes and somewhat simulate in appearance and function devices known as typewriters.

Intensive efforts in research and development in recent years have resulted in many improvements in printing devices. Many modern typewriters exhibit sophisticated characteristics which enable them to produce superior copy in both manual and automatic modes. For instance, instead of the usual type of key-moving carriage arrangement used in most typewriters, at least one typewriter utilizes a rotatable "daisy wheel" which moves in a direction transverse to the paper to be printed upon, thereby eliminating carriage movement. Likewise, developments have been made which have resulted in quieter typewriters, as well as typewriters which are less complex mechanically which results in greater reliability.

The greater printing speeds now obtainable have permitted very efficient automatic modes to be realized. Peripheral equipment such as magnetic card and tape units are commonplace. These memory and command units provide ease of error correction, data storage and low quantity line copy reproduction. Some presently known typewriters even have the capability of receiving and processing commands from computers.

Even with the advent of electronic components such as the keyboard disclosed in U.S. Pat. No. 3,778,817, most modern typewriters are relatively noisy since some impact mechanism must usually strike the paper or other receiving medium employed. Likewise, while the reliability of typewriters has been greatly increased, a relatively large number of parts are still employed. Additionally, the mechanical impact printing means generally employed limit either the maximum printing speed or the cost due to the need for multiple parallel printing elements to achieve high printing speeds.

SUMMARY OF THE INVENTION

It is therefore an object of this invention to provide a printing apparatus which fulfills the above-noted shortcomings of the prior art.

It is another object of this invention to provide a non-impact printing apparatus which is reliable, simple in construction and produces high quality fully stylized character fonts equal and/or superior to typewriter printing.

It is a still further object of this invention to provide a non-impact printing apparatus which employs electrostatics to produce a useful image.

Another object of this invention is to provide a non-impact printing apparatus which employs a unique synchronization drive train to control print head movement.

Yet another object of this invention is to provide a non-impact printing apparatus which may be operated in a manual mode, or, in the alternative, may operate automatically under the control of an electronic input.

Another object of this invention is to provide a non-impact printing apparatus which can take automatic instructions from a memory unit.

Still another object of this invention is to provide a non-impact printing apparatus which can take instructions from a remote control source.

Another object of this invention is to provide a non-impact printing apparatus which transfers image information to a receiving medium one line at a time.

Another object of this invention is to provide a non-impact printing apparatus which is capable of much greater than conventional serial printing speeds.

These and other objects are obtained by providing a non-impact printing apparatus which employs xerographic techniques to develop a latent image on a transparent photoreceptor and transfers it therefrom to a receiving medium.

BRIEF DESCRIPTION OF THE DRAWINGS

For a better understanding of the invention as well as other objects and further features thereof, reference is made to the following detailed disclosure of various preferred embodiments of the invention taken in conjunction with the accompanying drawings thereof wherein.

DESCRIPTION OF THE PREFERRED EMBODIMENTS

Figure 1:
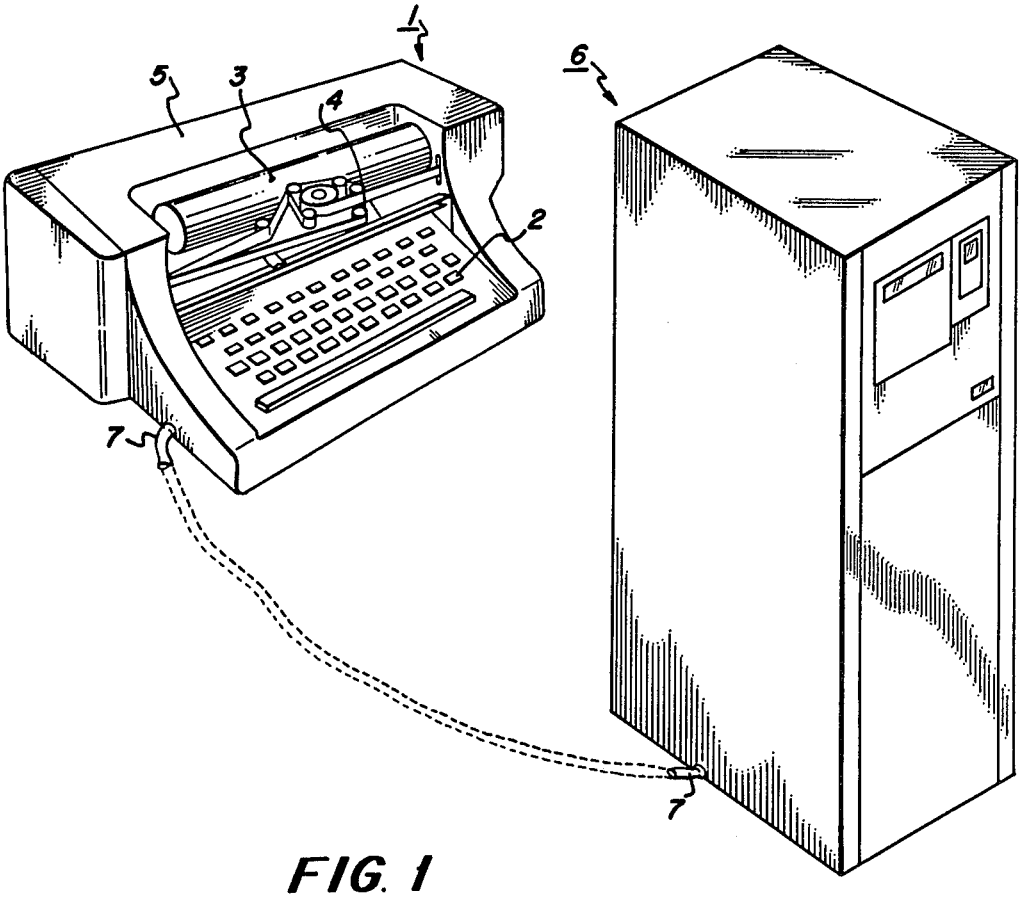
FIG. 1 is a perspective view of the general apparatus of the instant invention.

Briefly, FIG. 1 depicts a general representation of the printing apparatus of the instant invention. Typewriter 1 is comprised of a keyboard 2, a platen 3 upon which the receiving medium is contained and transferred, and a printing head 4 which may take several forms, as set forth below. Control and operating mechanisms are enclosed within the housing 5. Also shown in this figure is an optional automatic control unit 6 which is attached to typewriter 1 by cable 7. Control unit 6 is generally a memory unit of the type well-known in the art as a magnetic tape or magnetic card unit, but may also be an electronic reader or a transmission unit from a remote source. Any suitable automatic control source may be used.

Figure 2:
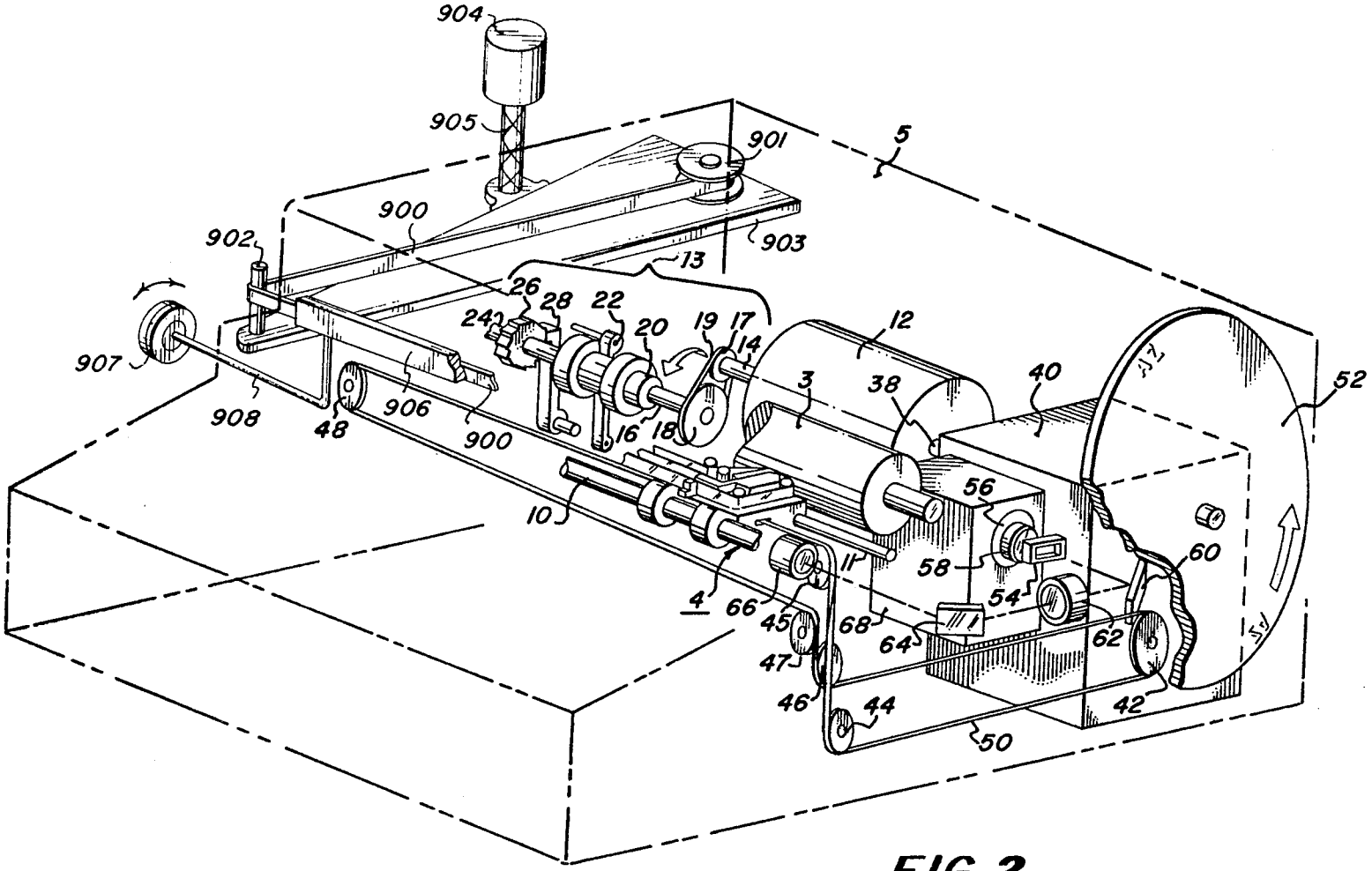
FIG. 2 is a partial perspective view of a print head drive suitable for use in the instant invention.

Attention is now directed to FIG. 2 wherein the printing head drive and generalized exposure system are shown. Within housing 5 a cylindrical platen 3 is supported at its ends for controlled axial rotation and advancement of the receiving medium which is partially wrapped therearound. The platen may be of any suitable construction well-known in the art. Printing head 4 is slidably mounted on two shafts 10 and 11 which permit the head to move axially along the length of the platen 3 as commanded by the drive mechanism. Printing head 4 may take any of the many forms set forth below, but generally requires the uniform transfer of material to the receiving medium, and therefore, the actual printing position is as nearly on a plane with the axis of the platen as is practicable.

The entire drive mechanism is powered by electric motor 12 which is coupled, on one end, to the imaging material supply and takeup reel drive means 13. Rotational power is transferred from motor shaft 14 to shaft 16 via pulleys 17, 18 and belt 19. Clutch 20 regulates the amount of rotational power transferred to coaxial shaft 24 under the control of escapement lever 22 whereby the takeup reel (not shown) is actuated. Ratchet 26 controls the outer portion of coaxial shaft 24, to which the supply reel (not shown) is attached. Upon activation of pawl 28 it moves out of engagement, and the supply reel is allowed to supply new imaging material under the urging of the imaging material tension. The takeup and supply reels, though not shown, may take any suitable form known in the art and may be mounted in any conventional manner so long as they are controlled by coaxial shaft 24. The imaging material on the reels is kept under constant tension by a suitable spring and roller means (not shown) which is attached to escapement lever 22 whereby the slack imparted by the feeding of new material causes the takeup reel to be actuated.

On the opposite end of electric motor 12 drive shaft 38 is coupled to synchronous cam print head drive 40, which will be described in more detail below. The output of print head drive 40 is concentrated primarily in drive pulley 42 which is made to rotate in either clockwise or counter-clockwise directions. Control cable 50 is fixed at both ends to print head 4, and through a series of fixed pulleys 44–48, causes the print head to slide along shafts 10 and 11 in response to the rotation of drive pulley 42.

Also driven by synchronous cam print head drive 40 is the character disc 52. Disc 52 is fully described in U.S. Pat. No. 3,750,539, but generally is a flat disc with transparent alpha-numeric regions in an otherwise opaque material along the periphery thereof in a slight helical path. The specific character to be printed is positioned in window 54 where illumination from lamp 56 and lens 58 projects an image thereof onto mirror 60. Lamp 56 may take many forms of rapid switching high intensity devices, but for purposes of illustration is a xenon flash lamp. The image on mirror 60 is transmitted through lens 62 onto mirror 64 and then to lens 66. Both lenses 62 and 66 are focused at infinity and have the appropriate relative size and focal lengths so to allow for the varying locations of the printing head 4 and provide the desired image size at the exposure plane.

Within print head 4 there are an array of mirrored surfaces or other conventional optic elements which direct the image to the recording medium either simultaneously with or before transfer to the receiving medium. Lamp housing 68 contains the switching mechanism and power supply for lamp 56.

Referring again to FIG. 2, it should be understood that platen 3 may be rotated by any of a number of structures well known or readily fashionable by one of skill in the art. For instance, a step motor geared to the platen shaft would allow complete control of the relative positioning of the print head and the receiving medium. By using sufficiently small steps, provision for plotting and super and subscript printing may easily be made. In the alternative, various ratchet and solenoid structures may be employed.

Figure 3:
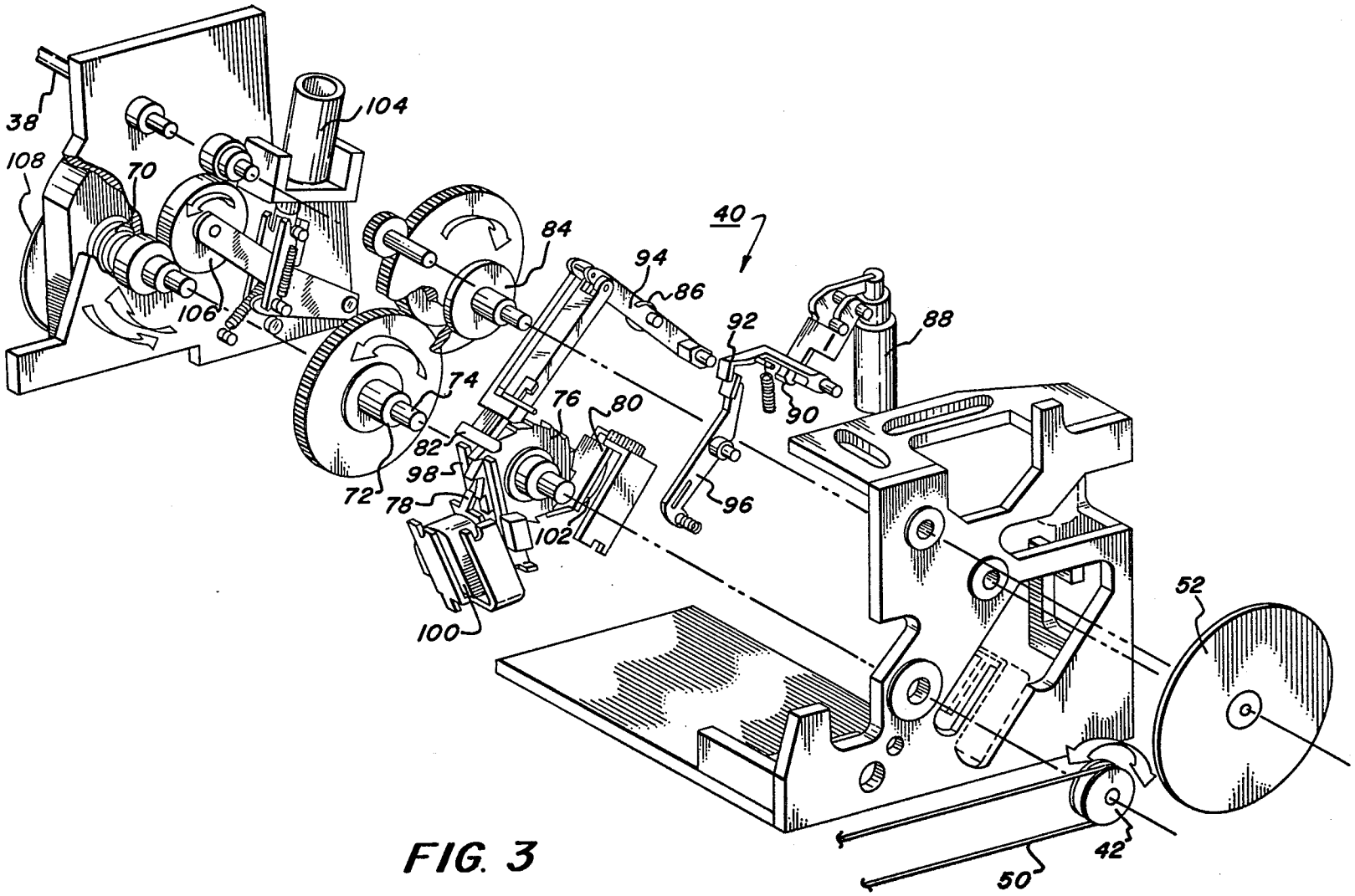
FIG. 3 is an exploded perspective view of the synchronous cam drive mechanism.

The prime function of synchronous cam print head drive 40, see FIG. 3, is to assure synchronous and phased motion between the print head 4 and the constant speed and relative position of character disc 52 at the instant of printing. As stated above, printing occurs when xenon lamp 56 flashes through the spinning character disc and the proper character is imaged on the moving print head. The helical displacement of characters on the disc compensates for the motion of the print head such that the selected character image from each character set on the wheel can be placed on the same lateral position on the paper.

The print head 4 is actually driven by a power spring 70 which is rewound during the print head return operation. However, the speed at which the power spring can move the head is limited by an overspeed clutch 72 which is geared directly to character disc 52. The power spring and overspeed clutch are concentric to the output shaft 74 on which are mounted the drive pulley 42 and control ratchet 76.

The control ratchet 76 is activated by two electrically operated stop pawls 78 and 80, and cam operated puller pawl 82. The puller pawl oscillates continuously under the influence of cam 84 and cam follower 86 and moves to turn ratchet 76 clockwise when released by latch solenoid 88. When the latch solenoid is energized, it inserts an interposer 90 between the latch 92 and the cam follower arm 94. When the arm 94 is driven against interposer 90 by cam 84, the latch 92 releases the pawl arm 96 which forces the puller pawl 82 into mesh with the teeth of ratchet 76.

The motion imparted to the ratchet by the cam, through the puller pawl, causes the ratchet (and thus the print head) to back up approximately $1\frac{1}{2}$ character spaces (ratchet teeth); then, the cam allows the power spring 70 to accelerate the ratchet in the forward direction until the ratchet speed is limited by the overspeed clutch 72. The puller pawl 82 is disengaged from the ratchet teeth by the release lever 98 just as the ratchet speed is being limited by the clutch. This limit is the synchronous speed during which printing occurs while the character disc and print head motions are in phase. The stop pawls are held out of engagement by their electromagnets 100 and 102 until released to stop the ratchet; at that time one of the stop pawls will be released by its electromagnet and engage the proper ratchet tooth, bringing the ratchet to a halt. The ratchet 76 is composed of two phase-shifted ratchet discs. Stop pawl 78 works on one disc of ratchet 76 and stop pawl 80 works on the other ratchet disc. Thus one stop pawl operates for all the even character positions and the other for the odd positions. Puller pawl 82 spans both discs.

The ratchet is driven in the return direction when the reverse solenoid 104 is energized and the friction reverse drive 106 rewinds the power spring 70.

The synchronous cam print head drive 40, shown in FIGS. 2 and 3, can be replaced by a D.C. step motor to provide a suitable and similar result. The output shaft of the step motor would, of course, control the movement of drive pulley 42 and character disc 52.

The light image from disc 52 ultimately reaches head 4 and strikes charged transparent photoreceptor 900 on the uncharged side to form a latent electrostatic image on the charged side. Transparent photoreceptor 900 is unwound from supply roll 901, around support post 902 and into a transfer position adjacent platen 3. Supply roll 901 and support post 902 are supported by support member 903. The entire support member 903, and with it transparent photoreceptor 900, are moved up and down by motor 904 and helically threaded shaft 905.

As transparent photoconductive ribbon 900 is moved down and then back up, it is uniformly charged, exposed to the light image from disc 52 and print head 4 and developed with marking material. After development, it is pressed into contact with a record receiving medium, such as paper, held by platen 3. Pressing is accomplished by heated plate 906 which is operated by stepping motor 907 through pivot arrangement 908. A more detailed description of the construction of the imaging arrangement and the method of its operation is provided in connection with FIGS. 13A–E, below.

CONTROL CIRCUITRY

Figure 4:
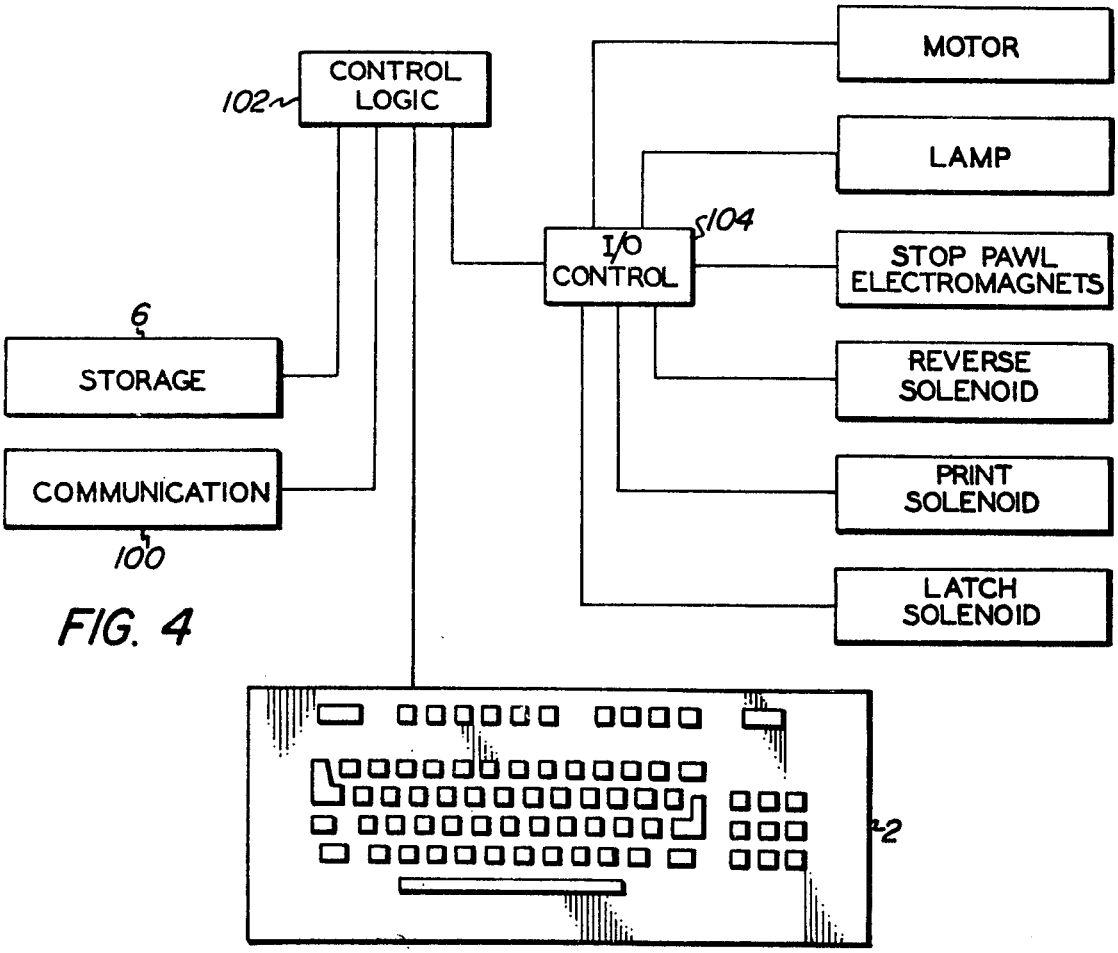
FIG. 4 is a schematic of a control circuitry suitable for use with the instant invention.

In FIG. 4 a basic schematic of the control circuitry is set forth. Command signals are provided through keyboard 2, storage unit 6 or communication unit 100. Unit 100 may be a telephone or like source, while storage unit 6 is generally a magnetic tape card, or disc-like recorder and/or reader. These command signals are in the form of electrical pulses which are directed to control logic circuitry 102. The control logic circuitry is the brain of the system and functions as a control center for all activities which take place while in the printing mode. Logic circuitry 102 may take any form known in the art such as, for example, an LSI Micro-Computer available from Fairchild, or may be made by one of skill in the art based upon system requirements.

Control logic 102 emits electrical pulse signals, corresponding to the command signals, which are received by I/O control unit (input and output) 104 which selectively activates the various system elements, such as shown in the figure. Control logic 102 has an internal clock function and memory which allows storage of the last specified number of command signals, say eight or ten, plus additional storage for another 5–10 command signals. The last eight or ten command signals are printed out in a burst or grouping whenever the interval between two successive signals is greater than a certain minimum time period, ¼ second for example. The ¼ second delay can be increased at the option of the operator, up to 1 to 2 seconds. This delay affords the operator a chance to eliminate real time detected typing errors by wiping out the memory before the delay period. The time period chosen should ordinarily be within the normal speed of a person of ordinary skill in touch typing. Storage of the last 8–10 characters is optional. The additional memory storage is used to allow printing during normal continous typing to occur in bursts. This provides for more efficient use of consumable materials as will be described below and reduces the noise, mechanism stress levels and wear.

From control logic unit 102, the command signals are directed to the operating elements of the system, as shown, in proper sequence.

The circuit elements of the system may take any conventional form, but for convenience, cost and space savings they should generally be of the solid state variety. Also, the specific circuit elements and layout are not shown inasmuch as the workable designs are infinite in number and well within the skill of the art once the desired sequencing is described.

XEROGRAPHIC EMBODIMENT WITH TRANSPARENT PHOTORECEPTOR

The structure shown in FIGS. 5A–D also relates to an impactless printing apparatus based upon the well-known imaging technology of xerography. The keyboard, logic and synchronous head drive are the same as described in previous embodiments and will therefore not be set forth in detail.

The platen 3 rotates about its horizontal axis under command signals from the logic circuitry and operates to move a receiving medium, usually paper, for receipt of the printed information. The printing cycle is concerned mainly with the performance of the various process steps upon an electrically photosensitive member which is in the form of a flexible ribbon contained by a supply reel and a driven takeup reel. Photosensitive member 750 is sufficiently transparent to allow a radiation image to pass therethrough and may take any of the forms well known in the art, as for example, a Mylar base (about 1 mil), a conductive layer (about 50A) and a Photoconductive layer (about 1 mil or less), usually organic. As will be appreciated after later discussion, the photosensitive member preferably exhibits a low surface energy to promote ease of release. This is easily accomplished by coating the surface with a releasing agent such as Teflon. Furthermore, the member 750 is generally considered to be a disposable component, but may be of such character as to be reusable two or more times. The ribbon is situated such that the photoconductive surface thereof faces the platen 3. The ribbon itself is sequentially transported through the process stations which are: charging 751, exposure and development 752 and transfer 753 (FIG. 5B).

Upon striking a character key the ribbon 750 is moved downward, past corona charging means 754 which may take any of the forms well known in the art such as those disclosed in U.S. Pat. No. 2,836,725 to Vyverberg or U.S. Pat. No. 2,777,957 to Walkup. After a uniform charge is placed upon the photosensitive member, it is further lowered into registry which bridge member 755 as shown in detail in FIG. 5C. The bridge member serves several purposes, but primarily insures a 2–10 mil gap between the toner laden donor belt 756 and photosensitive ribbon 750.

The ribbon 750 is transported through the various stations by movable frame member 757. Frame member 757 has the supply and takeup reels 758 and 759, respectively, rotatably mounted thereon so that these elements move up and down with the frame member, thereby transporting the ribbon through the station sequence. Takeup reel 759 is driven by an electric motor 760. Nut 761 is fixed to frame member 757 and threaded onto lead screw 762. The lead screw is rotatably supported at one end by a support base and driven at the other end by step motor 763, which is also fixed to a support. When motor 763 is activated, lead screw 762 rotates, causing the frame member 757 to move. Guide rods 764 insure that the frame member moves in substantially the desired path without undesirable motion.

The exposure and development station 752 structurally provides for flash exposure of the photosensitive member and touchdown development of the electrostatic latent image formed thereon. For convenience, it will be assumed that the front of the photosensitive element is that surface which is photoconductive, therefore, the instant system provides exposure through the rear and development on the front.

Exposure head 765 is slidingly mounted on shafts 10 and 11 and moves therealong under the command of control cable 50. Negative images (dark background) are projected from the illumination system through lens 66 onto reflection mirror 766, through opening 767, onto mirror 768 and thence to the photosensitive member 750. Negative images are required because they allow the superposition of successive character images onto member 750.

Toner donor belt 756 is an endless loop electrode which is kept at the same polarity or potential as photosensitive member 750. The belt is positioned on guide rollers to direct its travel onto bridge member 755 and through toner loading chamber 769. While in chamber 769, paddle wheel 770 or other suitable means, loads the toner 772 thereon. Slit exit openings 774 serve as a seal to prevent unwanted toner from escaping from the chamber and also insures that the belt 756 is not too highly loaded. The donor belt is driven by controlled friction drive roller 776, or other suitable means.

Figure 5A:
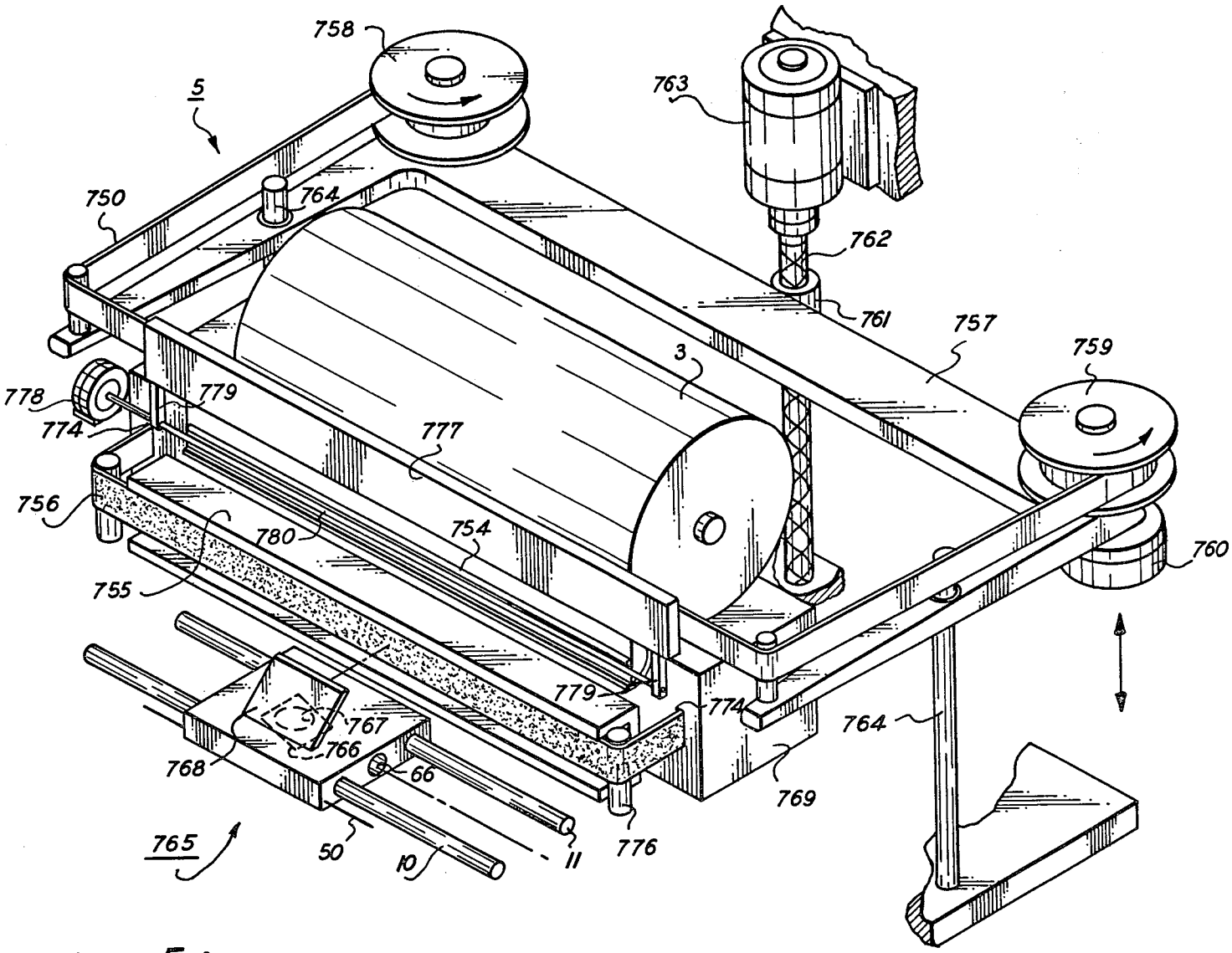
FIGS. 5A and B are partial perspective and side plane views, respectively, of another embodiment of printing apparatus which employs xerographic imaging techniques, with transparent photoreceptor.
Figure 5B:
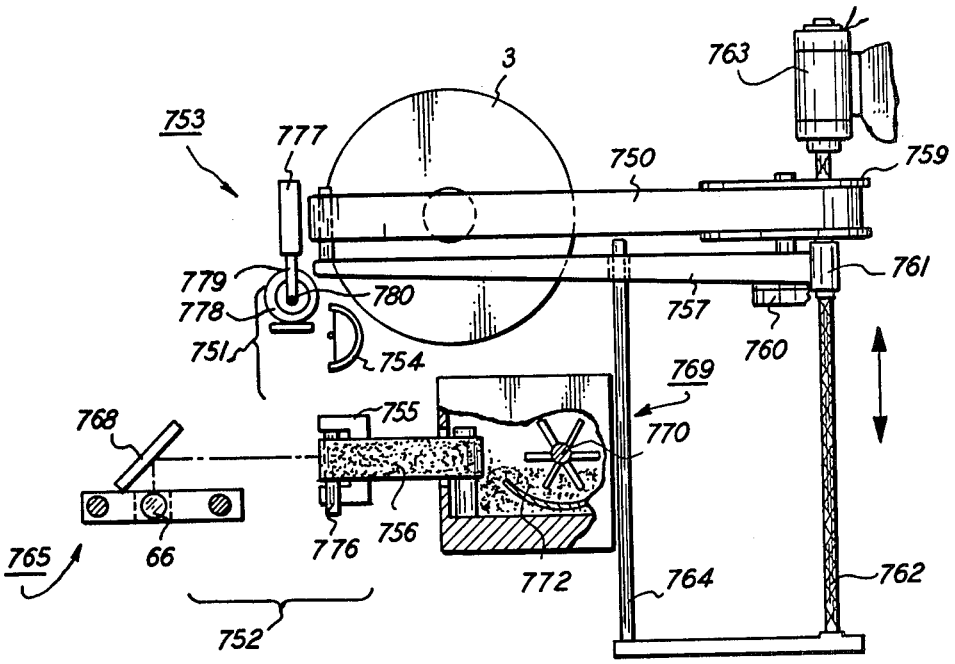
FIG. 5C is a parital side view of the development area of FIGS. 5A and B.
FIG. 5D is a partially schematic, partially cross-sectional view of the image transfer member shown in FIGS. 5A and B.
FIG. 5E is a partially schematic, cross-sectional view of a magnetic development apparatus suitable for use with the printing apparatus of FIGS. 5A and 14B.
Figure 5C:
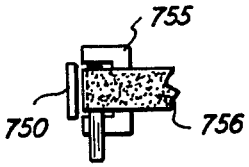
Figure 5D:
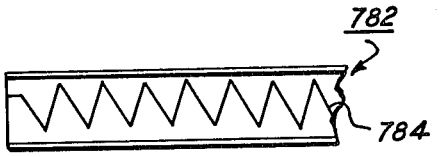

After a full line of characters has been printed, the carriage return key is punched and the image laden photosensitive element 750 is moved into the transfer position shown in FIGS. 5A and B. Heat transfer element 777 is then moved from its rest position, completely out of alignment with photosensitive member 750, into the transfer position shown in FIGS. 5A and B. Rotation solenoid 779 acts upon pivot arm 779 to rotate element 777 about rod 780 approximately 90° into and out of the transfer position. The heated transfer element, as best shown in FIG. 5D, which may be curved to fit platen 3 is of a rubbery material (e.g., silicone) with conductive wires 784 therein for heating the surface thereof (e.g., nickel). Any suitable pattern for the heating wires may be used, a zig-zag pattern being shown for illustration. In the alternative, a relatively small horizontally translated heated shoe could be used to perform the transfer step, but it would result in somewhat slower operation.

The transfer element is brought into intimate contact with the photosensitive member 750 and platen 3 to effect transfer and fusing. The rubbery characteristics and shape of element 777 are chosen to cause it and the photosensitive member to conform to the rounded contour of the platen 3.

The solid state control curcuitry is programmed such that the member 750 stays in the lower exposure and development position until either the carriage return key is struck, which causes transfer, or a specific time lapse occurs, e.g., ½ second. The time lapse relates generally to the speed of the operator and may be adjustable. By allowing the time lapse to occur, it is possible to view the imaged line before transfer, e.g., to check for errors. This is possible because the heat transfer element 777 is not in its transfer position and the photosensitive member is transparent.

Should an error be detected before transfer, the exposure head is backspaced to the last correct character before the error and an error key depressed. This automatically causes a complete new segment of photosensitive material and donor to move into position, and, from memory, the correct portion of the line to be reprinted. The remainder of the line is then correctly manually entered.

After the complete line is typed, the return key is depressed, the developed image is transferred, the platen rotates one line and the photosensitive and donor member advance one sequence. The next line is then ready for typing.

In certain circumstances the charge decay rate of the photosensitive member may affect the quality of the printed image, for example, if the typing is unusually slow. This is not usually a problem under normal conditions, however, the logic circuitry has a built in time control whereby the member 750 is recharged if transfer is not instigated within a set period.

It should also be noted that the operating speed of this embodiment may be significantly increased in an automatic printing mode by modifying the exposure system to include a second exposure head. The mounting of the two heads would also have to be modified so that they could be moved about a closed loop whereby one head would be in position on the left margin as the other moved out of position on the right.

The elements described go together to form an apparatus which forms alpha-numeric characters upon a sheet of paper. Therefore, it is obvious that the size of the elements generally permit the receipt of standard sized sheets--usually 11–16 inches in width.

Additionally, it should be apparent that the photosensitive member, while not in the viewing position, has to be protected from room light by shielding the lower region.

Figure 5E:
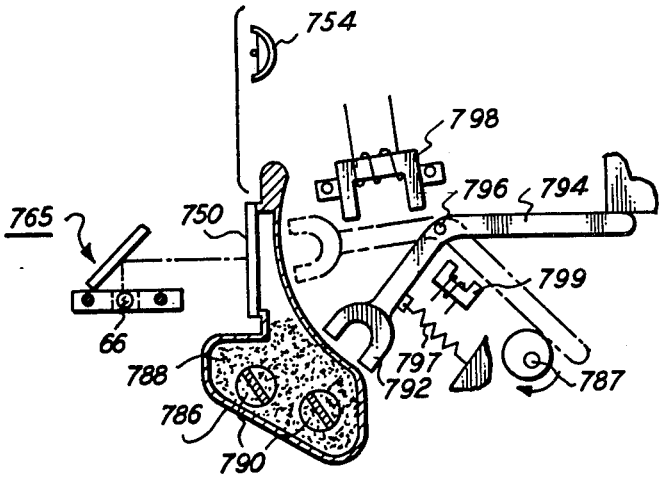

FIG. 5E shows an exceptionally effective alternative development station suitable for use in the xerographic embodiments. This embodiment would, for example, be substituted for the touchdown development station of FIGS. 5A and B.

Photosensitive ribbon member 750 is uniformly charged as it moves downward past corona charging means 754 to the position shown in FIG. 13E adjacent an opening in developer chamber 786. Developer chamber 786 is of any suitable size, but generally should be at least as long as the print path, or platen 3. The chamber has a reservoir in the lower portion thereof containing the magnetic development medium 788. An auger(s)

790 may be placed in the reservoir to insure even distribution and prevent caking of the material.

After the creation of an electrostatic latent image on photosensitive member 750, sufficient amount of magnetic developer material 788 is picked up by magnetic 792 and transported to the latent image to effect development. The magnet may be either permanent or electrically activated, depending upon design considerations. Also, it should be noted that chamber 786 should be narrow enough to allow the transported material to sweep by the latent image and develop same with a suitable volume of developer.

The magnet 792 can be caused to fluctuate between the pickup and development positions by innumerable structures; however, the arrangement shown is quite simple and reliable. The magnet 792 is fixed to support arm 794 which pivots about point 796 in response to electromagnet 799. Spring 797 aids the return motion of the magnet 792 from the development and pickup positions. When magnet 792 is in the development position, arm 794 rests upon cam 787 which causes the magnet to "jiggle" the developer material adjacent the latent image.

Many variations in the above-described structure are possible, but certain advantages accrue to a system which employs a characterized magnet as 792 for each printing position. Each magnet would have its own control electro-magnet 799, the activation of which would be tied to the position of the exposure head 765. Such an arrangement is an obvious advantage which results in superior characters. In certain instances, it may be desirable, e.g. in the automatic modes, to develop the characters a line at a time. This is accomplished by activating electro-magnet 798 which extends the full length of the printing line.

In a particularly preferred embodiment, the logic system would provide an internal clock function similar to that previously described. For example, if a partial line of characters is developed on member 750 and no further entry is made for ¼ second, the ribbon will move to its transfer position as shown in FIG. 5B. When the next entry is made, the ribbon goes down to the exposure-development position of FIG. 5E and is recharged. Then, the logic circuitry and memory unit causes the head 765 to backspace one character and re-expose the previously entered character, and then expose and develop the newly entered character. This procedure prevents the character being entered from scavenging the adjacent character.

TONER BELT SYSTEM

The immediately preceding xerographic embodiment of an impactless printing apparatus relies upon touch-down development to create a viewable image on a transparent photosensitive member. The toner donor belt runs through a channel within a bridge member in order to accurately position the toner relative to an electrostatic latent image. The system to be described below is an alternative to the cascade loading system within the toner loading chamber.

Figure 6B:
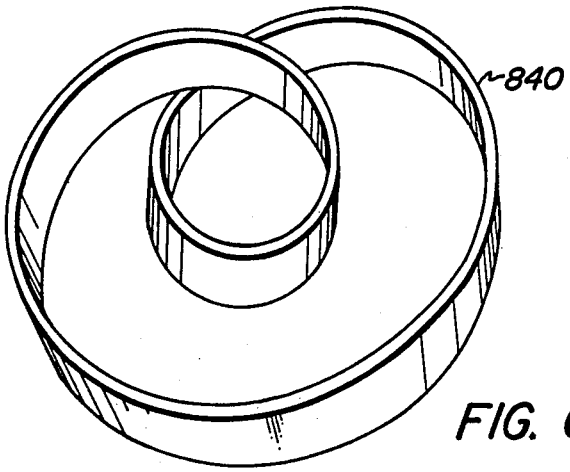
FIG. 6B is a perspective view of the donor belt of FIG. 6A.
Figure 6A:
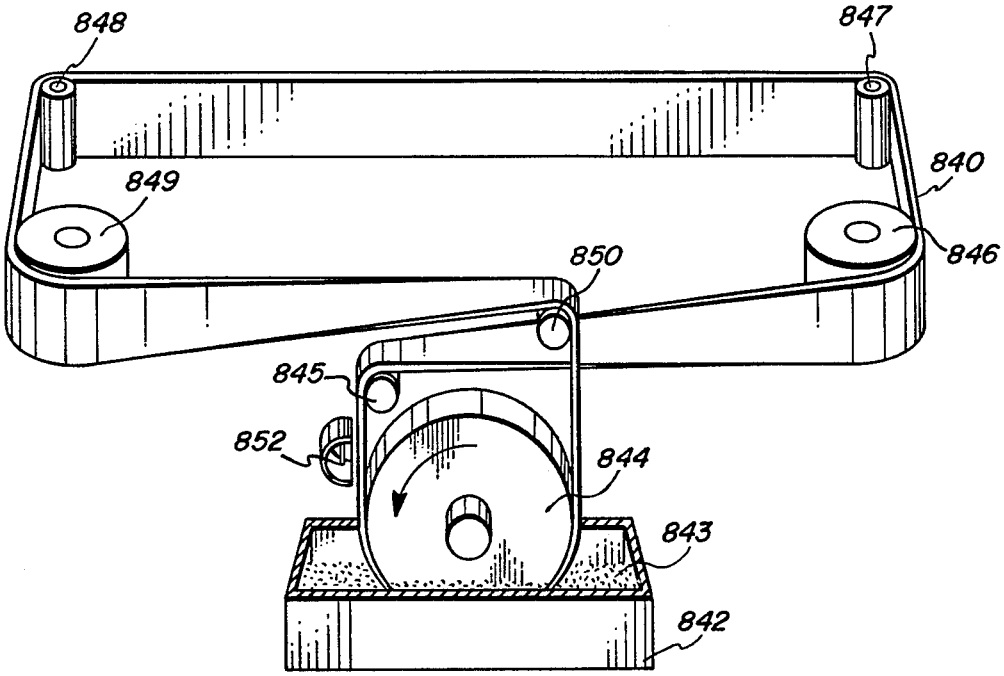
FIG. 6A is a partial schematic of an alternative development scheme for the FIG. 5 printing apparatus.

Referring now to FIG. 6A, a conductive toner donor belt 840 is formed in a closed loop, as will be further explained, and situated on various rollers to provide a surface which never contacts any of the rollers. This contact-free surface is highly efficient and well suited as a donor surface.

The belt 840 itself may be made of any of a number of materials, either conductive or insulative as taught in U.S. Pat. No. 3,487,775.

It has been found that most methods of applying marking material to a donor impart sufficient triboelectrically generated electrostatic charges to the marking material to cause the material to releasibly adhere to the donor. However, to impart additional charge to the marking material on a loaded donor or to refresh a loaded donor, independent means are known in the art to impart additional electrostatic charges to the marking material. These same means may be used to precharge an electrically insulating donor to increase its capacity to accept and releasably retain marking material. These means include corona charging an insulating layer and placing a bias on a conductive layer.

For convenience of illustration, belt 840 will be assumed to be a thin insulating layer such as Tedlar.

Suspended within toner containing tray 842 is biased drum 844 which forms an electrostatic development field which attracts toner 843 from the tray 842. The belt is situated on guide rollers 845–850 in such a manner that the tone laden surface thereof never touches a roller. Corotron 852 charges the toner layer which is then transported to the position between rollers 847 and 848. It is at this location that the belt rests upon the bridge member mentioned above. The drum 844 is driven under command of the logic circuitry and rotates to frictionally advance the donor as required.

It should be noted from FIGS. 6A and B that the belt 840 is made from a moebius strip. In other words, the belt is formed with a 360° axial twist, as shown in FIG. 6B.

Furthermore, it should be understood that the toner tray 842 may be continuously vibrated to prevent caking and promote charging of the particles. Also, the tray and drum may be enclosed to suppress the contamination of apparatus due to cloud formation.

Alternatively, and possibly preferably, the toner tray can be replaced by a narrow width magnetic brush which deposits a toner layer on the belt by solid area developing the bias on roll 844.

DONOR BELT

Figure 7A:
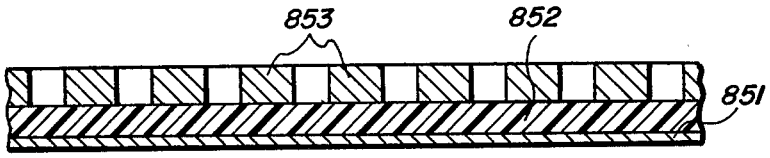
FIGS. 7A, B and C are views of an alternative embodiment of a donor belt.

An improved donor member for use in any suitable development environment, especially the one set forth immediately above, is shown in FIGS. 7A, B and C.

A thin conductive base layer 851 with a thickness of from about 25 to about 125 microns aids in the creation and maintenance of an electrical field, and also serves as a support for the member. Any suitable conductive material may be used, including nickel, copper and aluminum.

A thin insulating layer 852 is positioned upon conductive layer 851 in contact therewith. Layer 852 has a thickness from about 25 to about 50 microns and may comprise any suitable insulating material such as Tedlar, Mylar or polysulphone.

A screened conductive pattern 853 is then placed upon the free surface of insulting layer 852. The screen comprises a conductive material layer, such as described above, containing a pattern of substantially square openings ranging from about 250 to about 350 microns on a side. The screen is preferably from about 7 to about 20 microns thick.

Figure 7B:
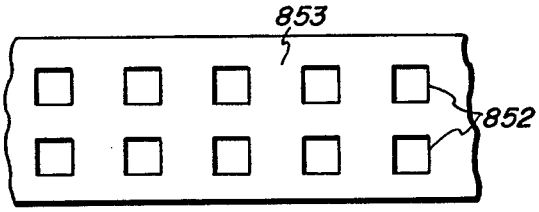
Figure 7C:
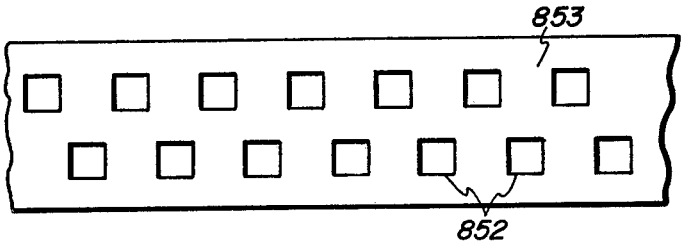

The pattern itself may be regular or irregular in nature but preferably takes one of the forms shown in FIGS. 7B and C, with approximately 50 percent open area. This open area is provided by lands of from about 50 to about 75 microns.

The donor member described, when properly charged or biased, produces a maximum amount of toner in a minimum amount of space and results in a superior touchdown development system.

It will be understood that various other changes of the details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention.

Although specific components and process steps have been stated in the above description of preferred embodiments of the invention, other suitable materials, proportions, elements and process steps, as listed herein, may be used with satisfactory results and varying degrees of quality. In addition other materials which exist presently or may be discovered may be added to materials used herein to synergize, enhance or otherwise modify their properties.

What is claimed is:

1. An imaging apparatus employing a transparent electrically photosensitive web member comprising:

(a) an elongate platen for supporting a receiving medium;

(b) means to suspend the photosensitive member in a plane substantially parallel to the axis of said platen, and to transport the photosensitive member through the various process means set forth below;

(c) charging means for placing a substantially uniform charge upon the side of the electrically photosensitive member closest to the platen;

(d) exposure means for imagewise exposing the electrically photosensitive member on the side opposite the charged side and creating an electrostatic latent image on the charged side, said exposure means further including a movable exposure head mounted for translation along a path parallel to the axis of said platen and means to advance said exposure head;

(e) development means for depositing marking material on the electrostatic latent image on the electrically photosensitive member;

(f) transfer station means for transferring the marking material image a line-at-a-time by heat and pressure to the receiving medium on said platen; and (g) first control means for controlling and coordinating the operation of said means to suspend and transport, said various process means set forth above, and said means to advance said exposure head, whereby an image is created, developed and transferred to a predetermined position on the receiving medium.

2. The apparatus of claim 1 wherein said first control means comprises a computer means adapted to respond to electrical command signals.

3. The apparatus of claim 2 further including an electronic keyboard connected to said computer means as a source of command signal.

4. The apparatus of claim 3 wherein said means to suspend and transport the electrically photosensitive member comprises:

a frame member adapted to suspend the electrically photosensitive member at least across the length of said platen, said frame member movably mounted to transport the electrically photosensitive member along a path substantially tangent to said platen from a position adjacent thereto to a location remote therefrom passing through each of the various process means.

5. The apparatus of claim 4 wherein the charging means comprises a corotron extending substantially the length of said platen and substantially parallel thereto.

6. The apparatus of claim 5 wherein said development means comprises:

means for supporting a donor web carrying marking material adjacent the path of the electrically photosensitive member.

7. The apparatus of claim 6 wherein said transfer means comprises:

a heated flexible pressure plate movably mounted to press the electrically photosensitive member into contact with the receiving medium on said platen.

8. The apparatus of claim 7 wherein said various process means are positioned along the path of the electrically photosensitive member in the following sequence and arrangement;

said corotron located adjacent said platen and positioned to place a substantially uniform charge on the surface of the electrically photosensitive member which would contact the receiving medium;

said means for supporting a donor web located adjacent said corotron on the side opposite said platen and positioned to deposit marking material on the surface of the electrically photosensitive member which would contact the receiving medium;

said exposure head located adjacent said means for supporting a donor web and positioned to expose the surface of said electrically photosensitive member which would not contact the receiving medium; and said pressure plate located adjacent said platen and positioned to contact the electrically photosensitive member and press same into contact with the receiving medium on said platen.

9. The apparatus of claim 8 wherein said development means further comprises means for loading marking material on the donor web.

10. The apparatus of claim 9 wherein said movable exposure head comprises:

a base member slidably mounted on a fixed support extending at least the length of said platen whereby said base member may, by action of said first control means, be selectively positioned anywhere along said support; and optical transport means affixed to said base member for receiving an illumination image and directing same at the electrically photosensitive member.

11. The apparatus of claim 10 wherein said means to advance said exposure head comprises:

a drive pulley and at least one idler pulley having a cable wrapped therearound and fixed at both ends to said exposure head, said pulleys positioned relative to each other and said exposure head such that rotation of said drive pulley causes said print head to move along a path parallel to the axis of said platen.

12. The apparatus of claim 11 wherein said exposure means further comprises:

a movable opaque mask having multiple imagewise-shaped transparent portions therethrough;

illumination means for directing illumination through one of said transparent portions at a time to said optical transport means;

means to move said opaque mask relative to said illumination means whereby others of said multiple imagewise-shaped portions may be selectively illuminated; and second control means to cause said means to move to said opaque mask relative to said illumination means said second control means connected to said computer means and coordinated with said first control means.

13. The apparatus of claim 12 wherein said opaque mask is a substantially circular disc having said transparent portions along the periphery thereof in a helical arrangement, said disc rotatable about its center under the influence of said means to move.

14. The apparatus of claim 13 further including supply and driven takeup means on said frame member adapted to selectively hold portions of the transparent electrically photosensitive web member.

15. The apparatus of claim 14 wherein said development means further includes a driven closed loop donor web cooperating with said means for loading and said means for supporting whereby marking material may be loaded on said donor web and presented for transfer to the electrically photosensitive member.

16. The apparatus of claim 5 wherein said development means comprises:

(a) a housing having an opening therein for receiving the electrically photosensitive member with the electrostatic latent image thereon directed into said housing, said housing further including a chamber, below said opening, for holding a quantity of magnetic marking material;

(b) first magnet means adjacent said housing for transporting the magnetic marking material from said chamber to said opening, whereby at least part of the magnetic marking material adheres to the electrostatic latent image on the electrically photosensitive member; and (c) means for cooperating with said first magnet means to move said first magnet means from a position near said chamber to a position near said opening.

17. The apparatus of claim 16 wherein said means to move said first magnet means comprises a second magnet means.

18. The apparatus of claim 17 wherein said housing comprises a concave arcuate outside wall opposite said opening extending at least from said chamber to a position substantially parallel with the top of said opening, and said first magnet means moves along said arcuate wall to transport the marking material from said chamber to the electrostatic latent image.

19. The apparatus of claim 18 wherein said means to move said first magnet means includes pivotable magnetically attractable support arm means attached to said first magnet means, and said second magnet means is positioned to attract said support arm means.

20. The apparatus of claim 19 wherein said support arm means is mechanically biased in a direction opposite to which said second magnet means tends to move it.

21. The apparatus of claim 20 further including means to jiggle said support arm means and first magnet means when said first magnet means reaches said opening.

22. The apparatus of claim 21 wherein said means to jiggle comprises a rotatable cam adapted to contact said support arm means.

23. The apparatus of claim 22 wherein said first magnet means comprises permanent magnet means and said second magnet means comprises electro-magnet means.

24. The apparatus of claim 23 wherein said first magnet means comprises a multiplicity of individual permanent magnets closely spaced adjacent each other along the length of said housing, said support arm means comprises a support arm attached to each of said multiplicity of permanent magnets, and said second magnet means comprises a single electro-magnet capable of simultaneously attracting all of the multiplicity of support arms.

25. The apparatus of claim 24 wherein said second magnet means further comprises a multiplicity of electro-magnets each capable of acting upon an individual support arm to move an individual permanent magnet from said chamber to said opening.

26. The apparatus of claim 25 wherein said means to move further includes means to selectively actuate said electro-magnets.

27. The apparatus of claim 26 further including anger means in said chamber to continuously agitate the developer material therein.

28. The apparatus of claim 27 wherein said transfer means comprises:

a heated flexible pressure plate movably mounted to press the electrically photosensitive member into contact with the receiving medium on said platen.

29. The apparatus of claim 28 wherein said various process means are positioned along the path of the electrically photosensitive member in the following sequence and arrangement;

said corotron located adjacent said platen and positioned to place a substantially uniform charge on the surface of the electrically photosensitive member which would contact the receiving medium;

said development means located adjacent said corotron on the side opposite said platen and positioned to deposit magnetic marking material on the surface of the electrically photosensitive member which would contact the receiving medium;

said exposure head located adjacent said development means and positioned to expose the surface of said electrically photosensitive member which would not contact the receiving medium; and said pressure plate located adjacent said platen and positioned to contact the electrically photosensitive member and press same into contact with the receiving medium on said platen.

30. The apparatus of claim 29 wherein said movable exposure head comprises:

a base member slidably mounted on a fixed support extending at least the length of said platen whereby said base member may, by action of said first control means, be selectively positioned anywhere along said support; and optical transport means affixed to said base member for receiving an illumination image and directing same at the electrically photosensitive member.

31. The apparatus of claim 30 wherein said means to advance said exposure head comprises:

a drive pulley and at least one idler pulley having a cable wrapped therearound and fixed at both ends to said exposure head, said pulleys positioned relative to each other and said exposure head such that rotation of said drive pulley causes said print head to move along a path parallel to the axis of said platen.

32. The apparatus of claim 31 wherein said exposure means further comprises:

a movable opaque mask having multiple imagewise-shaped transparent portions therethrough;

illumination means for directing illumination through one of said transparent portions at a time to said optical transport means;

means to move said opaque mask relative to said illumination means whereby others of said multiple imagewise-shaped portions may be selectively illuminated; and second control means to cause said means to move to said opaque mask relative to said illumination means said second control means connected to said computer means and coordinated with said first control means.

33. The apparatus of claim 32 wherein said opaque mask is a substantially circular disc having said transparent portions along the periphery thereof in a helical arrangement, said disc rotatable about its center under the influence of said means to move.

34. The apparatus of claim 33 further including supply and driven takeup means on said frame member adapted to selectively hold portions of the transparent electrically photosensitive web member.

* * * * *